US009344806B2

(12) United States Patent
Reinmuth

(10) Patent No.: US 9,344,806 B2
(45) Date of Patent: May 17, 2016

(54) COMPONENT HAVING A MICRO-MECHANICAL MICROPHONE STRUCTURE AND METHOD FOR PRODUCING THE COMPONENT

(75) Inventor: Jochen Reinmuth, Reutlingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 469 days.

(21) Appl. No.: 13/388,014

(22) PCT Filed: Jun. 2, 2010

(86) PCT No.: PCT/EP2010/057709
§ 371 (c)(1),
(2), (4) Date: Apr. 10, 2012

(87) PCT Pub. No.: WO2011/012360
PCT Pub. Date: Feb. 3, 2011

(65) Prior Publication Data

US 2012/0189152 A1 Jul. 26, 2012

(30) Foreign Application Priority Data

Jul. 31, 2009 (DE) ..... 10 2009 028 177

(51) Int. Cl.
*H04R 25/00* (2006.01)
*H04R 19/00* (2006.01)
*H04R 31/00* (2006.01)
*H04R 19/04* (2006.01)

(52) U.S. Cl.
CPC ..... *H04R 19/005* (2013.01); *H04R 31/00* (2013.01); *H04R 19/04* (2013.01); *Y10T 29/49005* (2015.01)

(58) Field of Classification Search
CPC ..... H04R 19/005; H04R 19/04; B81B 2201/0257; B81B 2203/0127; B81C 1/00
USPC ..... 381/113, 174–175, 191; 257/415–416
See application file for complete search history.

(56) References Cited

U.S. PATENT DOCUMENTS 6,522,762 B1 * 2/2003 Mullenborn ..... H04R 19/005 367/181
2003/0133588 A1 7/2003 Pedersen

FOREIGN PATENT DOCUMENTS

| | | |
|---|---|---|
| DE | 10 2005 056759 | 5/2007 |
| DE | 10 2006 016811 | 10/2007 |
| GB | 2 436 460 | 9/2007 |
| WO | 2004/106879 | 12/2004 |

* cited by examiner

*Primary Examiner* — Davetta W Goins
*Assistant Examiner* — Phylesha Dabney
(74) *Attorney, Agent, or Firm* — Norton Rose Fulbright US LLP

(57) ABSTRACT

Measures are provided for improving the acoustic properties of a component (10) having a micromechanical microphone structure realized in a layer construction (20) over a substrate (1), and for simplifying the production method. The microphone structure of such a component (10) includes a diaphragm (11) deflectable by acoustic pressure, spanning a cavity (13) that acts as a rear-side volume in the rear side of the component, and includes a stationary, acoustically permeable counter-element (12) situated over the diaphragm (11). According to the invention, the layer construction (20) has, between the diaphragm (11) and the substrate (1), an enclosing layer (3) in which there is fashioned an acoustically transparent aperture (4). The diaphragm (11) is connected to the rear-side volume (13) via this aperture in the enclosing layer (3). Under the enclosing layer (3), the rear-side volume (13) extends laterally beyond this aperture (4).

12 Claims, 6 Drawing Sheets

COMPONENT HAVING A MICRO-MECHANICAL MICROPHONE STRUCTURE AND METHOD FOR PRODUCING THE COMPONENT

FIELD OF THE INVENTION

The present invention relates to a component having a micromechanical microphone structure that is realized in a layer construction over a substrate. The microphone structure includes a diaphragm that is deflectable by acoustic pressure, spanning a cavity in the rear side of the component that acts as a rear-side volume, and includes a stationary acoustically permeable counter-element situated over the diaphragm. In addition, the present invention relates to a method for producing such a component.

BACKGROUND INFORMATION

MEMS (Micro-Electro-Mechanical System) microphones, whose active microphone structure is fashioned in a layer construction on a substrate, are known in practice. They usually detect acoustic pressure in the form of a change in capacitance between the acoustically active diaphragm and the largely rigid counter-element. The quality of the microphone signal depends essentially on the size and situation of the rear-side volume relative to the diaphragm. If bypass openings, or also web-type spring elements, are fashioned as diaphragm suspension in the edge region of the diaphragm, the connecting opening between the diaphragm and the rear-side volume should, as far as possible, extend only over the closed center region of the diaphragm in order to avoid an acoustic short-circuit. On the other hand, the attenuation of the microphone signal depends essentially on the size of the connecting opening and of the rear-side volume, so that these must have a minimum size in order to achieve a particular microphone sensitivity.

In order to realize the rear-side volume, it is known to use a rear-side etching process to etch through the substrate down to the active microphone structure. The rear-side volume is then terminated by mounting the component on a bearer, such as on a circuit board or in a housing.

In many respects, this variant turns out to be problematic. For example, the rear-side etching process must be matched very precisely to the situation, dimensions, and design of the microphone structure on the front side of the substrate. The etching front of the rear-side etching process should meet the closed diaphragm surface of the microphone structure very precisely in order to achieve the highest possible microphone sensitivity. This requires a very expensive and precise adjustment of the rear-side etching mask relative to the microphone structure on the front side of the substrate. Moreover, for the rear-side etching process only etching processes may be selected that produce a very precise reproduction of the etching mask. However, these processes mostly have a rather low etching rate. The known production process for components of the type named above is therefore relatively time-intensive and liable to error.

SUMMARY OF THE INVENTION

The exemplary embodiments and/or exemplary methods of the present invention provide measures by which the acoustic properties of a component having a micromechanical microphone structure are easily improved, and by which the production method is also simplified.

For this purpose, the layer construction of the component according to the present invention includes, between the diaphragm and the substrate, at least one enclosing layer in which there is fashioned an acoustically transparent aperture. Via this aperture, the diaphragm is connected to the rear-side volume, which according to the exemplary embodiments and/or exemplary methods of the present invention extends laterally under the enclosing layer, extending beyond the aperture.

According to the exemplary embodiments and/or exemplary methods of the present invention, it is proposed to define the opening connecting the active microphone surface to the rear-side volume independently of the rear-side structuring of the substrate, in the form of an aperture made in an additional enclosing layer of the layer construction. Together with the aperture, the enclosing layer forms a kind of enclosure for the diaphragm surface, and in this way enables the realization of a rear-side volume that is large compared to the active diaphragm surface. This is because the rear-side volume of the component according to the present invention extends laterally under the enclosing layer so as to extend beyond the aperture, and in this way can also extend beyond the active diaphragm surface. In this case, the enclosing layer prevents the occurrence of an acoustic short-circuit via openings that may be present in the edge region of the diaphragm.

According to the exemplary embodiments and/or exemplary methods of the present invention, the enclosing layer with the aperture is a component of the layer construction over the substrate. Accordingly, the enclosing layer, like the microphone structure, is produced in a front-side process. Due to the significantly smaller layer thickness, it is significantly easier to produce through-openings in the enclosing layer having a defined size and shape than in the substrate. Moreover, the aperture can very easily be positioned precisely underneath the active diaphragm surface, because the microphone structure is realized in a layer construction directly over the enclosing layer. Both the definition of the aperture and the design of the microphone structure take place with the aid of surface micromechanical processes that can readily be matched to one another.

As already mentioned, openings can be fashioned in the edge region of the diaphragm of a micromechanical microphone structure that, as bypass openings, enable a pressure compensation between the closed rear-side volume and the front side of the acoustically active diaphragm, or that are also part of a spring suspension by which the sensitivity of the diaphragm is increased. In this case, the acoustically transparent aperture in the enclosing layer advantageously extends only over the closed center region of the diaphragm. In this way, an acoustic short-circuit in the edge region is avoided.

In the simplest case, the acoustically transparent aperture of the component according to the present invention is a contiguous opening in the enclosing layer. However, the aperture can also be fashioned as a mesh or perforated hole structure in the enclosing layer. This variant turns out to be advantageous in particular if the diaphragm acts as a deflectable electrode, the stationary acoustically permeable counter-element includes at least one counter-electrode, and a charge voltage arrangement is provided for applying a charge voltage between the diaphragm and the counter-electrode. This is because in this case the mesh or hole structure in the enclosing layer can be used as a compensating electrode.

With the aid of a compensating voltage applied between the counter-electrode and the compensating electrode, the microphone function of the component according to the present invention can be realized in two ways that are different with regard to measurement technology, both ensuring a high measurement sensitivity and low liability to error.

In a first operational variant, the compensating voltage between the counter-electrode and the compensating electrode is selected as a function of the charge voltage of the measurement capacitance, in such a way that the electrical attraction produced by the charge voltage between the diaphragm and the counter-electrode is compensated by the compensating voltage. In this way, the movable diaphragm is situated in an almost potential-free space, where no electrostatic forces act on the diaphragm and diaphragm deflections are caused solely by acoustic pressure. For this reason, the charge voltage for the measurement capacitance can be set relatively high even given a small electrode spacing, in order to obtain a high measurement signal in the form of the change of voltage between the diaphragm and the counter-electrode. There is no danger here of an electrostatically caused collapse of the microphone structure.

In contrast, in a second advantageous operational variant the compensating voltage is regulated in such a way that the movable diaphragm is held as much as possible in its rest position even under the action of sound. In this case, the voltage between the counter-electrode and the diaphragm, which changes with the electrode spacing as a result of the acoustic pressure, is used as an actuating variable for the regulation of the compensating voltage. Here, the compensating voltage is used as a microphone signal. In this variant, it is also possible to work with relatively high charge voltages with a comparatively small electrode spacing. In addition, this variant proves to be particularly insensitive to electromagnetic interfering signals.

As already mentioned, the enclosing layer, and the microphone structure of the component according to the present invention, are produced in a front-side process. According to the exemplary embodiments and/or exemplary methods of the present invention, the definition of the aperture in the enclosing layer also takes place going out from the front side of the layer construction. For this reason, the position, shape, and size of the aperture can be specified very precisely. Because the aperture is not defined by the rear-side etching process, the adjustment of the rear-side etching process is relatively uncritical with regard to the acoustically active diaphragm surface. For the structuring of the rear side, it is also possible to use processes having a relatively low imaging precision but that are distinguished by a high etching rate. It is even possible to use strongly scattering etching processes that produce openings having negative edge steepness. In this way, the rear-side etching process can be significantly shortened. Moreover, thicker wafers can be used as component substrates in order to produce the required rear-side volume. This contributes significantly to the miniaturization of the microphone components.

For the definition of the aperture in the enclosing layer, two different method variants are proposed.

According to the one claimed method variant, a first electrically insulating sacrificial layer is applied onto the front side of the initial substrate and is structured, the position, geometry, and dimensions of an aperture being defined in an enclosing layer that is subsequently produced over the first sacrificial layer. The enclosing layer is then applied onto the first sacrificial layer structured in this way. Over this, the part of the layer construction is realized in which the diaphragm and the stationary acoustically permeable counter-element of the microphone structure are fashioned. In order to realize the rear-side volume, in a subsequent rear-side etching process a cavity is made in the rear side of the substrate. Here the substrate is etched all the way through its thickness down to the first sacrificial layer. In the region of the aperture not protected by the first sacrificial layer, the enclosing layer is also etched through. Only after this is the actual microphone structure exposed by sacrificial layer etching.

This method variant is advantageously used when the last etching phase of the rear-side etching process takes place anisotropically. In this way it is ensured that the aperture defined in the first sacrificial layer is transferred cleanly to the enclosing layer even if the enclosing layer is relatively thick. The structuring of the enclosing layer does not cause any additional topography on the front side of the layer construction, because here the enclosing layer is structured in the rear-side etching process.

According to the other claimed method variant as well, a first electrically insulating sacrificial layer is applied onto the substrate surface. This first sacrificial layer is however not structured in the region of the aperture. Instead, the enclosing layer applied onto the first sacrificial layer is structured. This produces an aperture having a defined position, geometry, and defined dimensions. Over this, the part of the layer construction is again realized in which the diaphragm and the stationary acoustically permeable counter-element are fashioned. Subsequently, a cavity is made in the rear side of the substrate, the first sacrificial layer acting as an etching stop boundary. The aperture in the enclosing layer is here first exposed together with the microphone structure through sacrificial layer etching.

This method variant is advantageously used if particularly large rear-side volumes are to be produced. This is because it is also possible to use isotropic etching methods for the rear-side processing, due to the first sacrificial layer, closed in the region of the aperture, and the already-structured aperture in the enclosing layer.

In a particularly advantageous method variant, the cavity is made in the rear side of the substrate through a combination of an anisotropic and a subsequent isotropic etching step. Here, the substrate rear side is undermined, and a relatively large rear-side surface remains for the mounting of the component.

As discussed above, there are various possibilities for realizing and developing the teaching of the present invention. For this purpose, on the one hand reference is made to the claims subordinate to the independent patent claims, and on the other hand reference is made to the following description of two exemplary embodiments of the present invention on the basis of the Figures.

DETAILED DESCRIPTION

Figure 1:
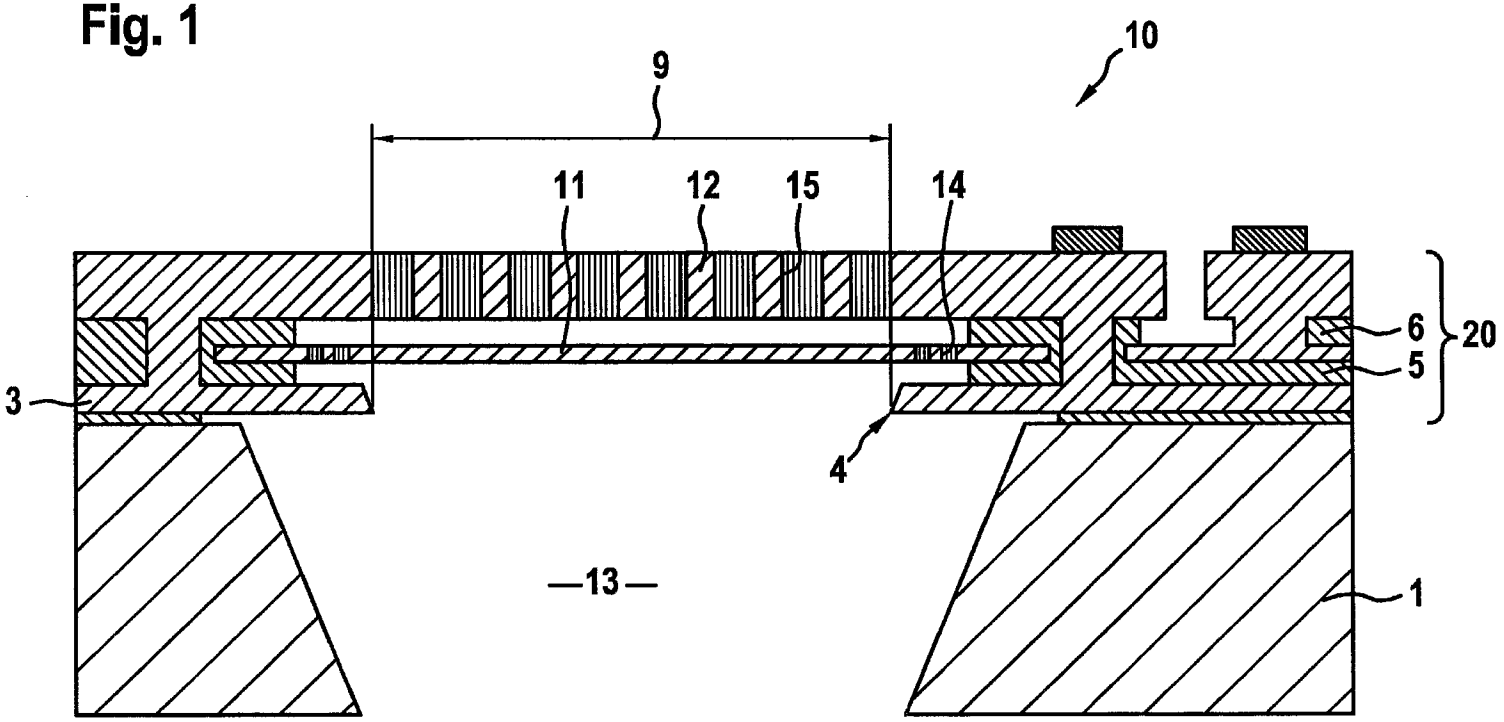
FIG. 1 shows a schematic sectional representation of a component 10 according to the present invention having a micromechanical microphone structure.

Component 10 shown in FIG. 1 includes a micromechanical microphone structure that is fashioned in a layer construction 20 over a substrate 1. This microphone structure is essentially made up of a diaphragm 11 deflectable by acoustic pressure and a stationary acoustically permeable counter-element 12 situated over diaphragm 11. Diaphragm 11 spans a cavity 13 fashioned in the component rear side.

According to the exemplary embodiments and/or exemplary methods of the present invention, layer construction 20 has between diaphragm 11 and substrate 1 an enclosing layer 3 in which an acoustically transparent aperture 4 is fashioned. In the exemplary embodiment shown here, aperture 4 is realized in the form of a contiguous opening in enclosing layer 3. Via this aperture 4, diaphragm 11 is connected to cavity 13, which forms the rear-side volume for the microphone structure. The position, shape, and size of aperture 4 are here matched precisely to the position and geometry of the acoustically active region of diaphragm 11, as indicated by double arrow 9. In contrast, the rear-side volume extends under enclosing layer 3 laterally beyond aperture 4, and thus also beyond the acoustically active region of diaphragm 11.

In the edge region of diaphragm 11 there are situated bypass openings 14 via which there takes place a pressure compensation between rear-side volume 13 and the front side of diaphragm 11. Bypass openings 14 can for example be realized as intermediate spaces between the spring elements of a diaphragm suspension. In order to avoid an acoustic short-circuit via these bypass openings 14, aperture 4 in enclosing layer 3 extend only over the acoustically active closed center region of diaphragm 11.

In the exemplary embodiment shown here, counter-element 12 is significantly thicker than member 11, and is thus essentially rigid. Moreover, counter-element 12 has a mesh structure having through-openings 15, so that it is acoustically permeable over the closed center region of diaphragm 11.

Diaphragm 11 is electrically insulated, via insulating layers 5 and 6, against enclosing layer 3 on the one hand and against counter-element 12 on the other hand. Both diaphragms 11 and counter-element 12 are made, at least in some regions, of an electrically conductive material such as a correspondingly doped polysilicon. Counter-element 12, situated over diaphragm 11 in the layer construction, here includes a counter-electrode for diaphragm 11 that acts as a deflectable electrode. Together, they form a measurement capacitance that is charged, using an arrangement not specifically shown, for the application of a charge voltage. In this way, deflections of diaphragm 11 can be acquired as changes in capacitance or fluctuations of a voltage picked off at the measuring capacitance.

The production of component 10 shown in FIG. 1 is explained in the following on the basis of FIGS. 2*a* through 2*d*.

Figure 2A:
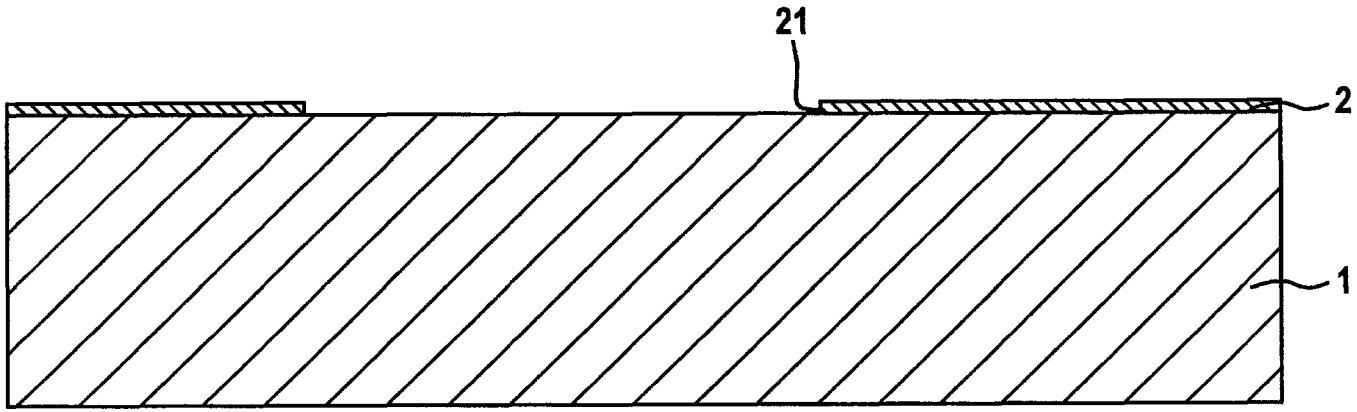
FIGS. 2*a*, 2*b*, 2*c*, and 2*d* illustrate the individual method operations for producing component 10 on the basis of schematic sectional representations.

The production method begins with a substrate 1, such as a silicon wafer, on which first a first sacrificial layer 2 is deposited and structured. Here an opening 21 is produced in sacrificial layer 2 whose position, shape, and size corresponds to the aperture in the enclosing layer that is to be applied subsequently. Substrate 1 with structured sacrificial layer 2 is shown in FIG. 2*a*. The sacrificial layer material, both the first and of the additional sacrificial layers, is typically a thermal oxide or a TEOS oxide that, in the context of component 10, also forms an electrical insulation for individual layer regions.

Figure 2B:
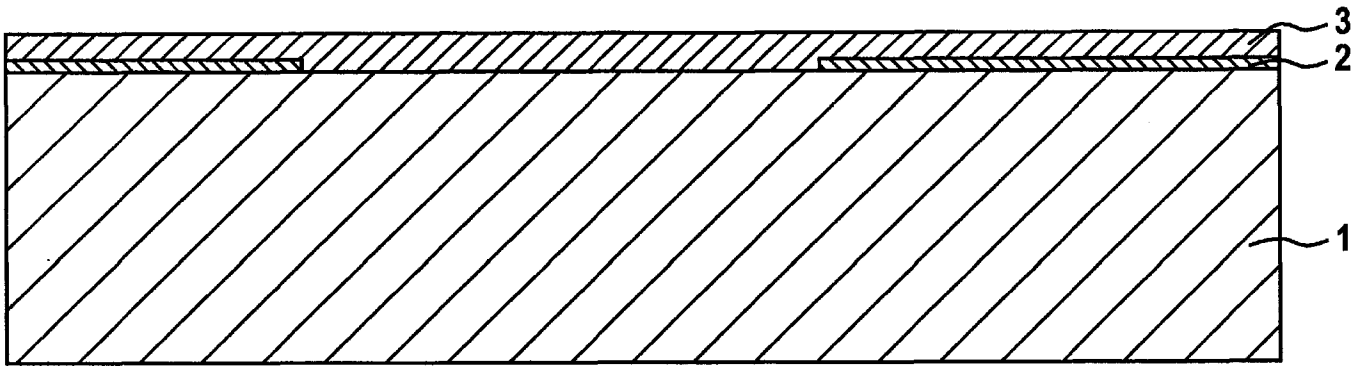

FIG. 2*b* shows the layer construction after the application of enclosing layer 3, grown directly on the substrate surface in the region of opening 21. Enclosing layer 3 is a polysilicon or epi-polysilicon layer that is typically significantly thinner than substrate 1.

Figure 2C:
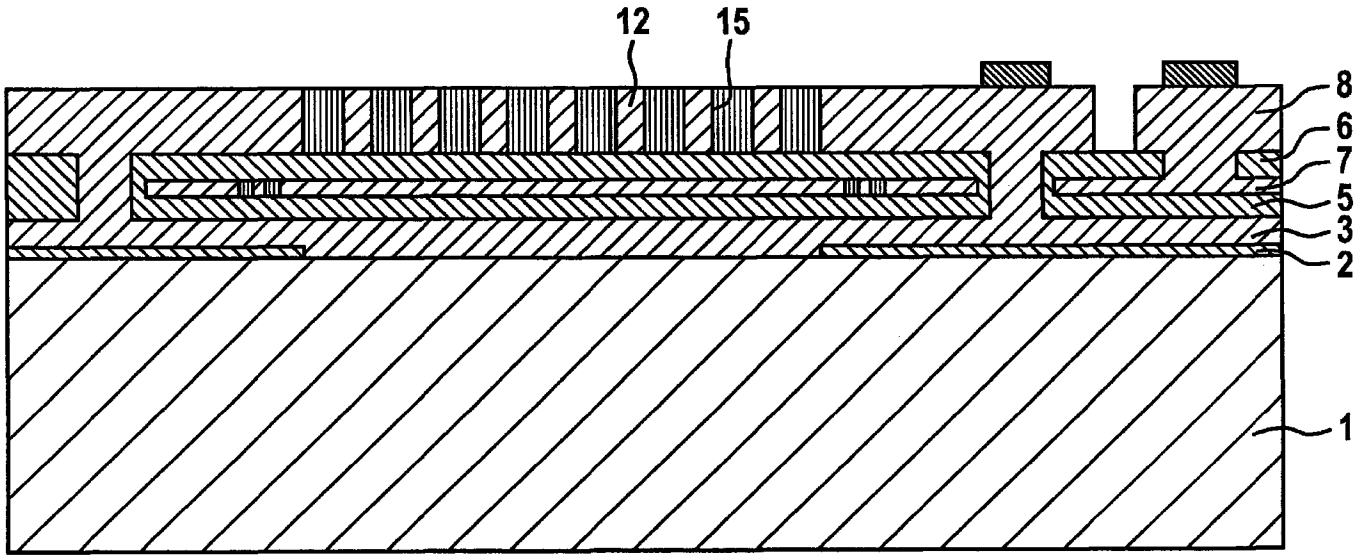

The layers of the microphone structure are now produced and structured over enclosing layer 3. For this purpose, first a second electrically insulating sacrificial layer 5 is applied onto enclosing layer 3 and structured, and a diaphragm layer 7 that is electrically conductive in at least some regions is then produced and structured over this sacrificial layer. Diaphragm layer 7 can for example be a doped polysilicon layer in which a spring suspension is realized for diaphragm 11 in order to promote diaphragm deflections and in this way to increase the microphone sensitivity. A third sacrificial layer 6 is applied onto diaphragm layer 7 and structured. Third sacrificial layer 6 ensures on the one hand the electrical insulation of diaphragm layer 7 against a thick conductive layer 8 subsequently applied onto sacrificial layer 6, layer 8 being for example a thick epi-polysilicon layer. On the other hand, third sacrificial layer 6 defines the distance between member 11 and counter-element 12, which is fashioned from thick conductive layer 8 in a front-side trench process and provided with through-openings 15. Here, third sacrificial layer 6 acts as a stop layer. The result of this process sequence is shown in FIG. 2*c*.

Figure 2D:
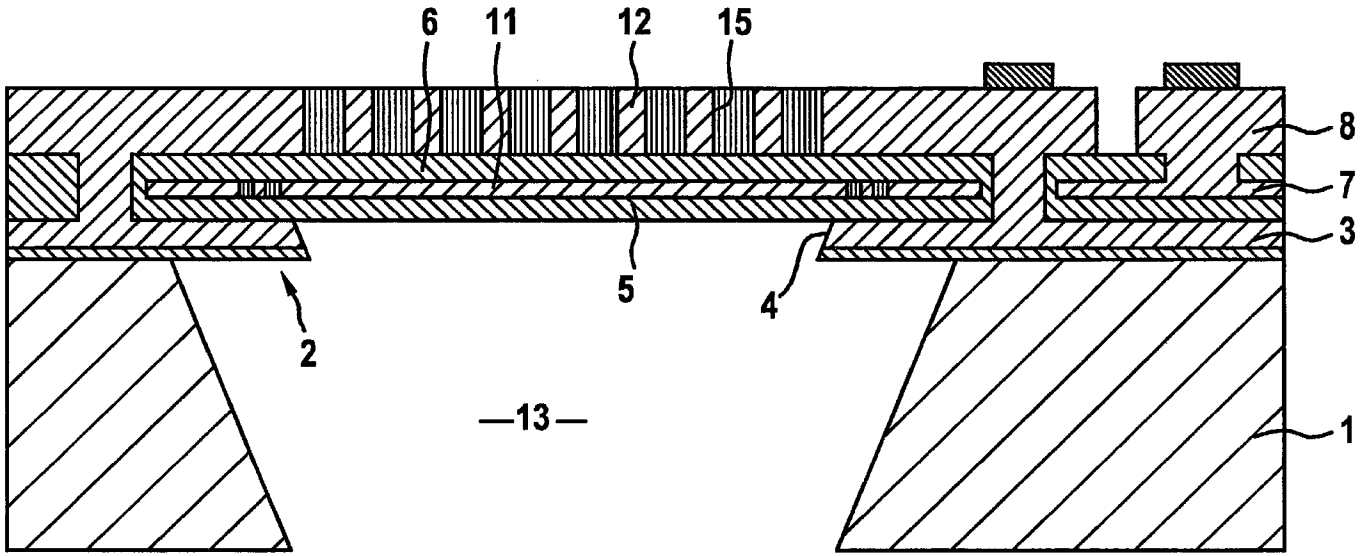

Only after this is a cavity 13 made in the rear side of substrate 1, as is shown in FIG. 2*d*. For this purpose, in the exemplary embodiment described here a predominantly anisotropic etching process is used that produces an opening having negative edge steepness. In this etching process, the substrate material was removed in the region underneath the closed center region of diaphragm 11, and the immediately adjacent material of enclosing layer 3 was also removed, creating aperture 4. First sacrificial layer 2 acts, in the edge region of cavity 13, as an etching stop layer, as does second sacrificial layer 5 in the region of aperture 4.

Finally, the material of the second and third sacrificial layers 5, 6 is removed in the diaphragm region in order to expose diaphragm 11 in diaphragm layer 7 between counter-element 12 in conductive layer 8 and aperture 4 in enclosing layer 3. This sacrificial layer etching yields a component 10 as shown in FIG. 1.

Figure 3:
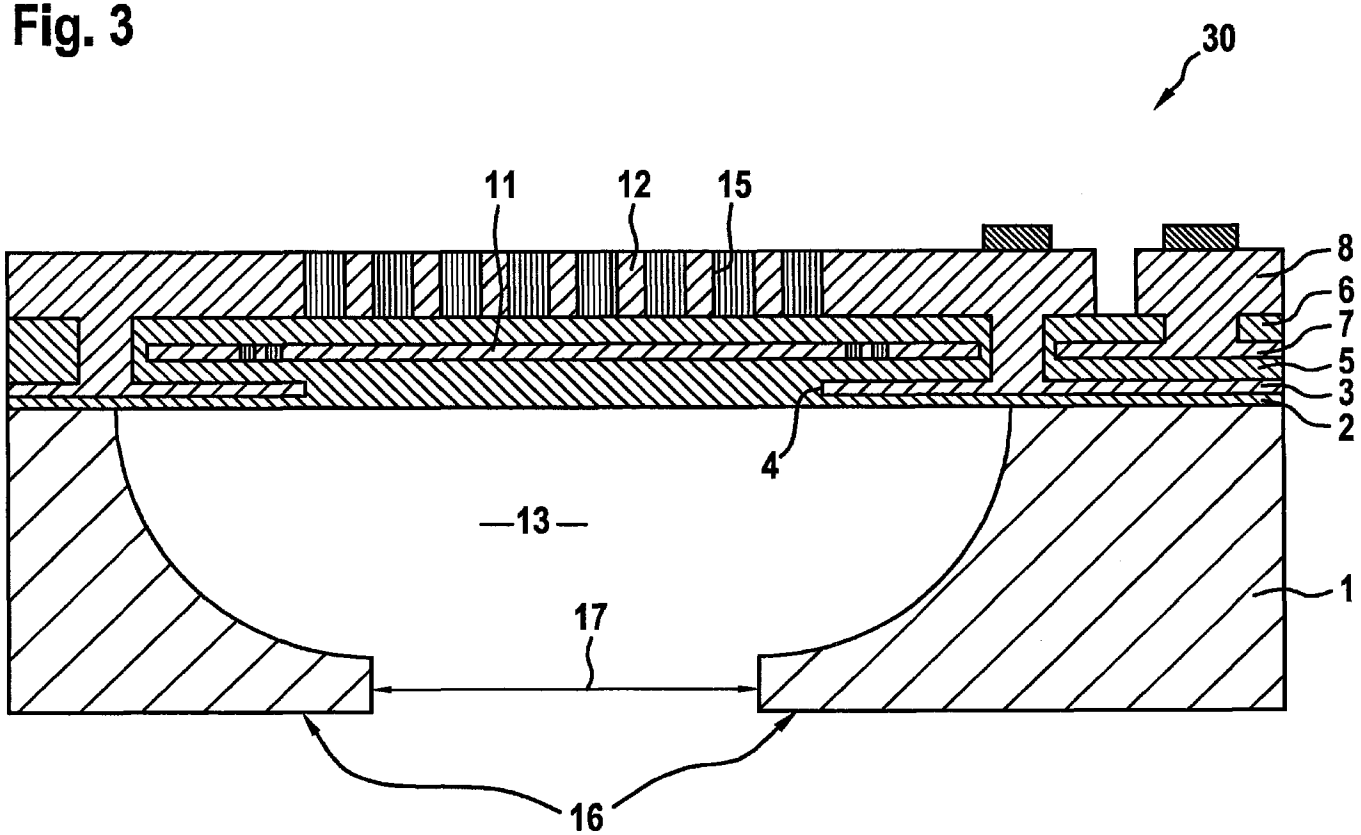
FIG. 3 shows a schematic sectional representation of the layer construction 30 of a further component according to the present invention before the exposure of the micromechanical microphone structure.

Layer construction 30 shown in FIG. 3 illustrates a production variant that also begins with a substrate 1. Here as well, first a first sacrificial layer 2 is applied onto the substrate surface. In contrast to the method variant described in connection with FIGS. 2*a* through 2*d*, this sacrificial layer 2 is not structured. Over first sacrificial layer 2, an enclosing layer 3 is then deposited and structured, producing an aperture 4 having a well-defined position, shape, and size.

As in the method variant shown in FIGS. 2*a* through 2*d*, the layers of the microphone structure are now produced and structured over structured enclosing layer 3. For this purpose, first a second electrically insulating sacrificial layer 5 is applied onto enclosing layer 3 and structured, aperture 4 being embedded in sacrificial layer material. Over second sacrificial layer 2, a diaphragm layer 3 that is electrically conductive at least in some regions is then produced and structured. The acoustically active center region of diaphragm 11 formed in this way is situated precisely over aperture 4 in enclosing layer 3. On diaphragm layer 7, a third sacrificial layer 6 is now applied and structured onto which a thick conductive layer 8 is then grown. From this layer 8, counter-element 12 having through-openings 15 is then formed using a front-side trench process.

Not until after this is a cavity 13 made in rear side 16 of substrate 1, by removing the substrate material down to first sacrificial layer 2. In the exemplary embodiment described here, substrate rear side 16 is opened, in an anisotropic etching process, for this purpose. This creates the relatively small rear-side opening 17 of cavity 13. The rear-side processing was then continued with an isotropic etching process by which substrate rear side 16, and also the edges of aperture 4 in enclosing layer 3, were undercut so that the cavity volume is large compared to rear-side opening 17, and also compared to aperture 4. FIG. 3 shows the component structure before the exposure of diaphragm 11 and of aperture 4 in a sacrificial layer etching process in which the material of the first, second, and third sacrificial layers 2, 5, and 6 is removed in the diaphragm region.

The method variant described in connection with FIG. 3 permits the production of particularly small components that, due to the lateral undercutting of the aperture in the enclosing layer, have a relatively large rear-side volume. Moreover, these components have, due to the lateral undercutting of the substrate rear side, a comparatively large mounting surface for affixing the component to a bearer or in a housing.

What is claimed is:

1. A component, comprising:

a micromechanical microphone structure realized in a layer construction over a substrate, the microphone structure including:

a diaphragm that is:

arranged over, and that spans, a cavity acting as a rear-side volume in the rear side of the component; and deflectable by acoustic pressure caused by acoustic waves entering the cavity via the diaphragm from outside the component; and a stationary acoustically permeable counter-element that is situated over the diaphragm;

wherein:

the layer construction between the diaphragm and the substrate includes at least one enclosing layer;

an acoustically transparent aperture is configured in this enclosing layer, via which the diaphragm is connected to the rear-side volume;

the enclosing layer surrounding the aperture forms an undercutting section, which the substrate does not contact;

the rear-side volume extends under the undercutting section of the enclosing layer, laterally beyond the aperture;

a lateral width of a rear-side opening in the rear-side volume is smaller than an interior lateral width of the rear-side volume; and the enclosing layer, when viewed in a cross-section that is in a plane parallel to a center axis of the diaphragm, includes at least one portion that, laterally in a direction towards a center axis of the diaphragm:

extends from over a top surface of the substrate towards a lateral edge of the top surface of the substrate;

continues onward to pass over the lateral edge of the top surface; and continues onward to beyond the lateral edge of the top surface of the substrate, thereby forming the undercutting section.

2. The component of claim 1, wherein the diaphragm is provided between the counter-element and the aperture, and wherein the diaphragm is electrically insulated against the counter-element and against the enclosing layer containing the aperture.

3. The component of claim 1, wherein at least one of a diaphragm suspension and bypass openings are configured in the edge region of the diaphragm, and wherein the acoustically transparent aperture in the enclosing layer extends only over the closed center region of the diaphragm.

4. The component of claim 1, wherein the acoustically transparent aperture is configured as a contiguous opening in the enclosing layer.

5. The component of claim 1, wherein the acoustically transparent aperture is configured as a mesh structure or perforated hole structure in the enclosing layer.

6. The component of claim 5, the diaphragm acting as a deflectable electrode, the stationary acoustically permeable counter-element including at least one counter-electrode, and arrangement being provided for applying a charge voltage between the diaphragm and the counter-electrode, wherein the mesh or perforated hole structure in the enclosing layer acts as a compensating electrode, and arrangement are provided for applying a compensating voltage between the counter-electrode and the compensating electrode.

7. The component of claim 1, wherein the diaphragm extends over the enclosing layer laterally beyond the aperture.

8. A method for producing a component including a micromechanical microphone structure, in which a diaphragm and a stationary acoustically permeable counter-element are realized in a layer construction over a substrate, the method comprising:

defining a position, a shape, and dimensions of an acoustically transparent aperture in an enclosing layer between the substrate surface and the diaphragm layer in a front-side process;

configuring the diaphragm and the counter-element in a layer construction over the enclosing layer; and making a cavity in the rear side of the substrate and connecting it to the microphone structure through exposure of the aperture in the enclosing layer;

wherein:

the aperture is laterally undercut, so that the rear-side volume extends laterally beyond the active diaphragm surface;

the diaphragm is:

arranged over, and spans, the cavity acting as a rear-side volume in the rear side of the component; and deflectable by acoustic pressure caused by acoustic waves entering the cavity via the diaphragm from outside the component;

the stationary acoustically permeable counter-element is situated over the diaphragm;

the layer construction between the diaphragm and the substrate includes the enclosing layer;

the diaphragm is connected to the rear-side volume via the aperture;

the enclosing layer surrounding the aperture forms an undercutting section, which the substrate does not contact;

the rear-side volume extends under the undercutting section of the enclosing layer, laterally beyond the aperture;

a lateral width of a rear-side opening in the rear-side volume is smaller than an interior lateral width of the rear-side volume; and the enclosing layer, when viewed in a cross-section that is in a plane parallel to a center axis of the diaphragm, includes at least one portion that, laterally in a direction towards a center axis of the diaphragm:

extends from over a top surface of the substrate towards a lateral edge of the top surface of the substrate;

continues onward to pass over the lateral edge of the top surface; and continues onward to beyond the lateral edge of the top surface of the substrate, thereby forming the undercutting section.

9. The method of claim 8, wherein:

at least one first electrically insulating sacrificial layer is applied onto the substrate surface and structured;

subsequently:

the enclosing layer is produced on the structured first sacrificial layer, with the first sacrificial layer separating the enclosing layer from the substrate; and the position, geometry, and dimensions of the aperture are defined in the produced enclosing layer;

at least one second electrically insulating sacrificial layer is applied on the enclosing layer and structured;

a diaphragm layer that is electrically conductive at least in some regions is produced and structured over the second sacrificial layer;

at least one third electrically insulating sacrificial layer is applied and structured over the diaphragm layer;

a layer that is electrically conductive at least in some regions is produced over the third sacrificial layer to realize the stationary counter-element;

this conductive layer is structured in a front-side trench process, the third sacrificial layer acting as a stop layer;

a cavity is made in the rear side of the substrate to realize a rear-side volume, the first sacrificial layer in the edge region of the cavity and the second sacrificial layer in the region of the aperture acting as stop layers; and at least the second and third sacrificial layers are removed in the diaphragm region to expose the diaphragm in the diaphragm layer between the counter-element in the conductive layer and the aperture in the enclosing layer.

10. The method of claim 8, wherein:

at least one first electrically insulating sacrificial layer is applied onto the substrate surface;

subsequently:

the enclosing layer is produced and structured on the first sacrificial layer, with the first sacrificial layer separating the enclosing layer from the substrate; and the aperture is produced with a defined position, geometry, and defined dimensions;

at least one second electrically insulating sacrificial layer is applied on the enclosing layer and structured;

a diaphragm layer that is electrically conductive at least in some regions is produced and structured over the second sacrificial layer;

at least one third electrically insulating sacrificial layer is applied and structured over the diaphragm layer;

a layer that is electrically conductive at least in some regions is produced over the third sacrificial layer to realize the stationary counter-element;

this conductive layer is structured in a front-side trench process, the third sacrificial layer acting as a stop layer;

a cavity is made in the rear side of the substrate to realize a rear-side volume, the first sacrificial layer acting as an etching stop boundary; and the first, second, and third sacrificial layers are removed in the diaphragm region and in the region of the aperture to expose the diaphragm in the diaphragm layer between the counter-element in the conductive layer and the aperture in the enclosing layer.

11. The method of claim 8, wherein the cavity is made in the rear side of the substrate through a combination of an anisotropic etching step and a subsequent isotropic etching step.

12. The method of claim 8, wherein as a substrate a silicon substrate is used, and the first sacrificial layer is formed from a thermal oxide or a TEOS oxide, and a polysilicon layer or an epi-polysilicon layer is used as an enclosing layer.

* * * * *